US008197355B2

(12) United States Patent
Galloway, Sr.

(10) Patent No.: US 8,197,355 B2
(45) Date of Patent: Jun. 12, 2012

(54) IRON-TYPE GOLF CLUB HEAD WITH CHAMFERED LEADING EDGE

(75) Inventor: J. Andrew Galloway, Sr., Escondido, CA (US)

(73) Assignee: Callaway Golf Company, Carlsbad, CA (US)

( * ) Notice: Subject to any disclaimer, the term of this patent is extended or adjusted under 35 U.S.C. 154(b) by 87 days.

(21) Appl. No.: 12/862,570

(22) Filed: Aug. 24, 2010

(65) Prior Publication Data

US 2011/0077103 A1 Mar. 31, 2011

Related U.S. Application Data

(60) Provisional application No. 61/246,046, filed on Sep. 25, 2009.

(51) Int. Cl.
*A63B 53/04* (2006.01)

(52) U.S. Cl. ..... 473/328; 473/349; 473/350

(58) Field of Classification Search ..... 473/324–350, 473/287–292; D21/747–752, 759
See application file for complete search history.

(56) References Cited

U.S. PATENT DOCUMENTS

| | | | | | |
|---|---|---|---|---|---|
| 1,505,296 | A | * | 8/1924 | Smith | 473/328 |
| D184,054 | S | * | 12/1958 | Huthsing | D21/751 |
| 3,068,011 | A | * | 12/1962 | Naojiro | 473/328 |
| 3,138,386 | A | * | 6/1964 | Onions | 473/328 |
| 3,897,065 | A | * | 7/1975 | Solheim | 473/349 |
| D239,550 | S | * | 4/1976 | Timbrook | D21/750 |
| 5,154,423 | A | * | 10/1992 | Antonious | 473/328 |
| 5,282,625 | A | * | 2/1994 | Schmidt et al. | 473/350 |
| 5,326,105 | A | * | 7/1994 | Fenton, Jr. | 473/328 |
| D352,082 | S | * | 11/1994 | Schroder | D21/748 |
| D371,181 | S | * | 6/1996 | Antonious | D21/748 |
| D371,182 | S | * | 6/1996 | Stites | D21/749 |
| D371,183 | S | * | 6/1996 | Antonious | D21/748 |
| 5,704,849 | A | | 1/1998 | Schmidt et al. | |
| D393,676 | S | * | 4/1998 | Frazetta | D21/747 |
| 5,749,795 | A | | 5/1998 | Schmidt et al. | |
| 5,776,010 | A | | 7/1998 | Helmstetter et al. | |
| 5,921,869 | A | | 7/1999 | Blough et al. | |
| 5,938,540 | A | * | 8/1999 | Lu | 473/288 |
| 5,971,868 | A | | 10/1999 | Kosmatka | |
| 6,045,455 | A | | 4/2000 | Kosmatka | |
| D426,603 | S | * | 6/2000 | Besnard et al. | D21/747 |
| 6,186,905 | B1 | | 2/2001 | Kosmatka | |
| 6,210,290 | B1 | | 4/2001 | Erickson et al. | |
| 6,251,029 | B1 | * | 6/2001 | Roberts | 473/328 |
| D503,203 | S | * | 3/2005 | Wood et al. | D21/747 |
| 7,083,531 | B2 | | 8/2006 | Aguinaldo et al. | |
| 7,112,148 | B2 | | 9/2006 | Deshmukh | |
| 7,144,336 | B2 | | 12/2006 | Reyes et al. | |
| 7,326,126 | B2 | | 2/2008 | Holt et al. | |
| 7,338,387 | B2 | | 3/2008 | Nycum et al. | |
| 7,338,389 | B2 | | 3/2008 | Wieland et al. | |
| 7,393,286 | B1 | * | 7/2008 | Renegar | 473/328 |
| D574,914 | S | * | 8/2008 | Oldknow et al. | D21/759 |

(Continued)

*Primary Examiner* — Sebastiano Passaniti
(74) *Attorney, Agent, or Firm* — Michael A. Catania; Rebecca Hanovice; Sonia Lari

(57) ABSTRACT

An iron-type golf club head having a coated stepped sole is disclosed herein. The coated stepped sole is stepped such that the sole surface furthest from the face is raised away from the turf to minimize the turf contact through a golfer's swing particularly for the longer, less lofted irons. The surface friction is reduced by applying a thin dense chromium coating thorough electroplating to the stepped sole.

2 Claims, 16 Drawing Sheets undercut angle 610
Included angle 6 sided 720 deg

U.S. PATENT DOCUMENTS

D577,399 S * 9/2008 Oldknow et al. ..... D21/759
D580,503 S * 11/2008 Roach et al. ..... D21/747
D583,433 S * 12/2008 Oldknow et al. ..... D21/759
D625,375 S * 10/2010 Kim et al. ..... D21/748
D633,159 S * 2/2011 Holt et al. ..... D21/747
2002/0198062 A1* 12/2002 McCabe et al. ..... 473/290
2008/0287215 A1* 11/2008 Deng et al. ..... 473/349
2009/0082133 A1* 3/2009 Tseng ..... 473/349

* cited by examiner $$\text{Undercut Angle} = \frac{\sum \theta_n}{360} \quad ; \theta_n = \text{angles subtending undercutsegments}$$

undercut angle 610
Included angle 6 sided 720 deg

IRON-TYPE GOLF CLUB HEAD WITH CHAMFERED LEADING EDGE

CROSS REFERENCES TO RELATED APPLICATIONS

The present application claims priority to U.S. Provisional Patent Application No. 61/246,046, filed on Sep. 25, 2009, which is hereby incorporated by reference in its entirety.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head. More specifically, the present invention relates to a golf club head having a plurality of grooves.

2. Description of the Related Art

Irons are typically composed of a stainless steel or titanium material, and are typically cast or forged. Most golfers desire that their irons have a large sweet spot for greater forgiveness, a low center of gravity to get the ball in the air, a solid sound, reduced vibrations during impact, and a trim top line for appearance. Unfortunately, these desires are often in conflict with each other as it pertains to an iron.

The golf club sole and the leading edge have meaningful effects on how well the club head maintains speed and direction. For many clubs and shots it is desirable to impact the ball just before the club down swing is complete, this to achieve improved spin for the situation. To achieve this, the club has to contact the ball and transfer energy to the ball near simultaneously with the turf. Should the club pass through the turf before the energy is transferred to the ball, the ball speed and spin are diminished. Also, on contact with the turf, particularly in a downward hit, the impact can be felt as harsh by the golfer. Some golfers become timid about swinging the club toward the turf and attempt to pick the ball off the turf without contact. In general, a divot is taken to allow the club head to contact the ball in the most advantageous orientation. Contacting the ball just prior to the ground is the intent, but for most golfers there a errors in delivering the ball. It is preferable that the club head's path follow through the turf. Often the club head impacts the turf before the ball due to variation in the swing path and, or because the ball lies in the turf such that ball and turf must be hit for the most advantage. Event he best of players require this shot at times.

Golfers gain advantage by reducing variation of the ball flight. Executing the require swing and impact is necessary for the best results. There are variations in the swing and in the contact location of the club, ball impact. The mass properties of the club head are tailored to achieve the mass properties to minimize the impact of variations in the swing. Common faults and common expectations can be identified and details of the club design such as mass properties and the geometry of the head are used to better serve the identifiable segments. The mass properties designer to better an identified segment can be achieved in various geometries and constructions. These geometries also affect the many other properties of the club head. This invention enables the construction of club heads that simultaneously improve geometry driven mass properties, aesthetic appeal and forces during impact. Some of the impact forces degrade the head, ball impact orientation and speed. Impact can also result in harshness felt in the golfer's hands.

BRIEF SUMMARY OF THE INVENTION

The purpose of this invention is to minimize the impact variations, allow preferred geometries for specific mass properties, turf impact and functional and aesthetic appeal.

The invention creates a geometry that is aesthetically pleasing, consistent with the best mass properties and accommodating to the golfers interest in sole shapes that minimize interference between the turf and club head. This is accommodated by combining features of better player clubs and with improving player clubs. The radius of the face to sole transition is designed to be a smaller radius to maximize the extension of the flat face within the ball contact locations. Also the radius design penetrated the turf better than a more blunt face to sole transition.

The sole is extended away from the face to improve the mass properties of the center of mass, the mass distribution, appeal, and for clearance between the club head and the turf during the follow through of the swing. The sole is stepped such that the sole surface furthest from the face is raised away from the turf to minimize the turf contact through the swing particularly for the longer, less lofted "irons". The surface friction is reduced by applying a thin dense chromium coating thorough electroplating.

The appeal of the step and associated geometry is detailed for both appearance and preferential shape.

The invention creates a unique combination of head shape and surface friction coefficients that minimize the bad effects of turf impact. Further, this invention creates a geometry that is aesthetically pleasing, consistent with the best mass properties and accommodating to the golfers interest in sole shapes that minimize interference between the turf and club head. This is accommodated by combining features of better player clubs and with improving player clubs. The radius of the face to sole transition is designed to be a smaller radius to maximize the extension of the flat face within the ball contact locations. Also the radius design penetrated the turf better than a more blunt face to sole transition.

The sole is extended away from the face to improve the mass properties of the center of mass, the mass distribution, appeal, and for clearance between the club head and the turf during the follow through of the swing. The sole is stepped such that the sole surface furthest from the face is raised away from the turf to minimize the turf contact through the swing particularly for the longer, less lofted irons.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
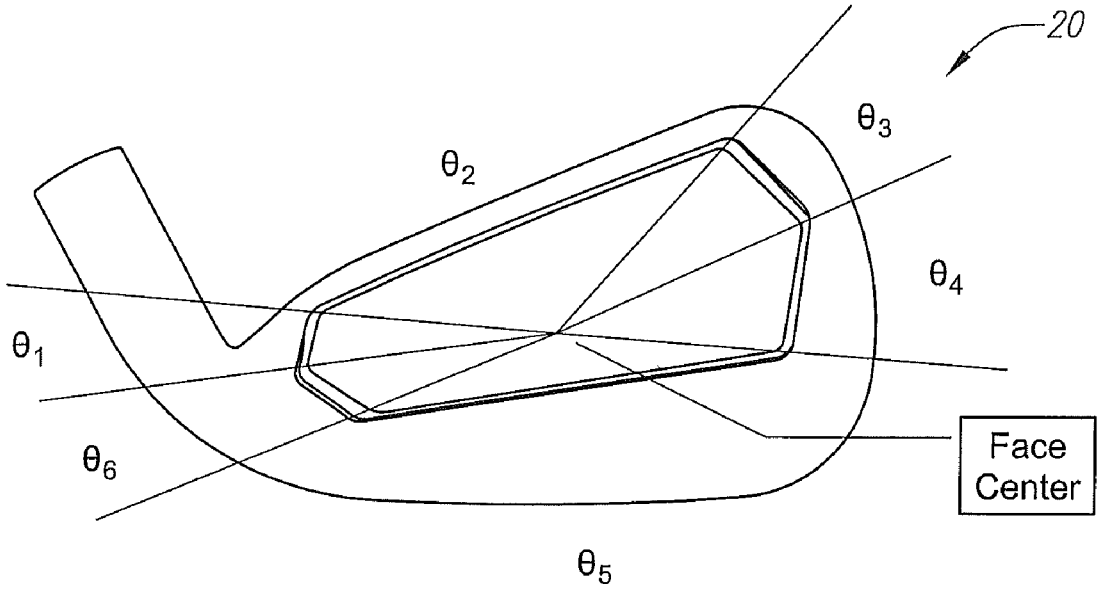
FIG. 1 is a back view of an iron-type golf club head illustrating angle partitions for an undercut in a rear cavity.
Figure 4:
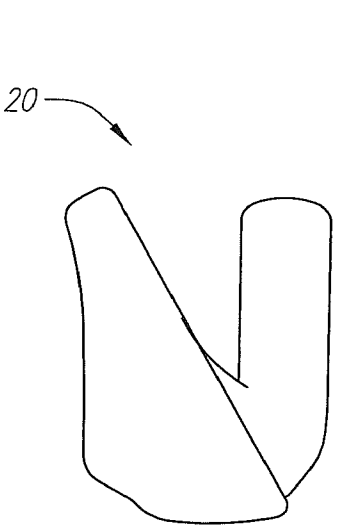
FIG. 4 is a toe side view of an iron-type golf club head.
Figure 3:
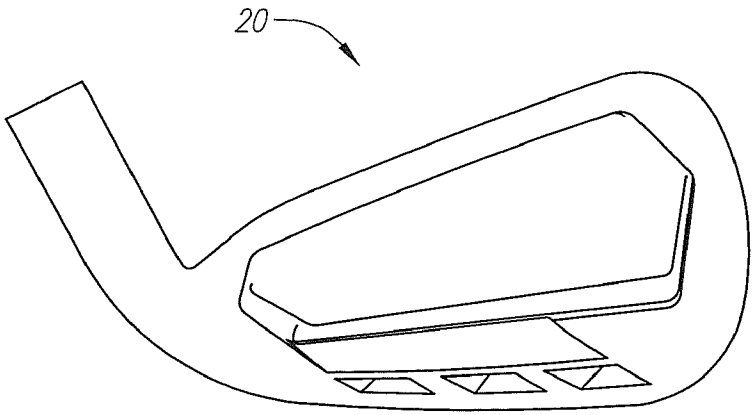
FIG. 3 is a rear view of an iron-type golf club head.
Figure 5:
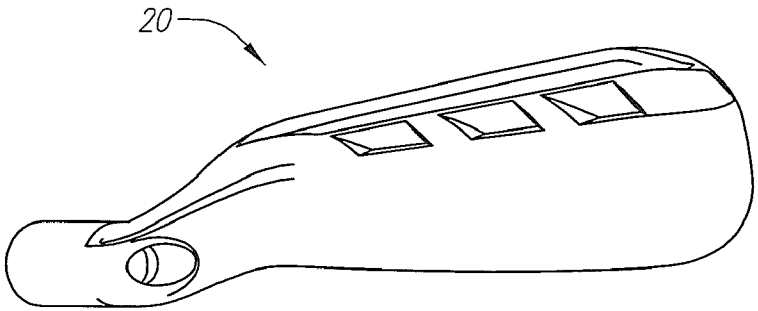
FIG. 5 is a bottom plan view of an iron-type golf club head.
Figure 2:
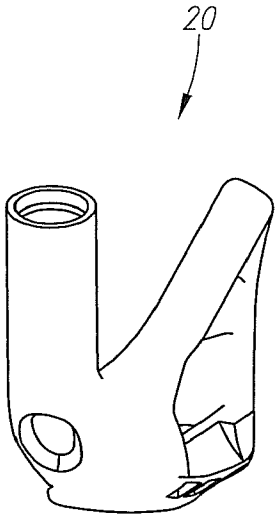
FIG. 2 is a heel side view of an iron-type golf club head.
Figure 6:
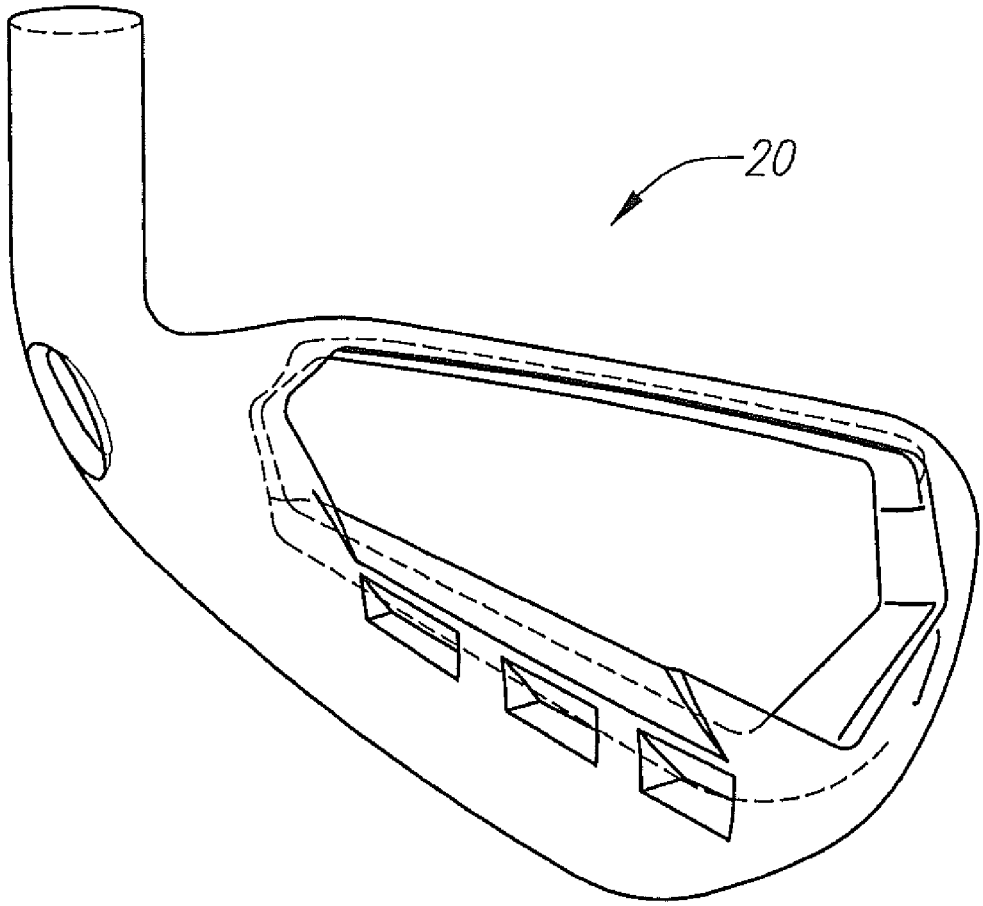
FIG. 6 is a bottom perspective view of an iron-type golf club head.
Figure 7:
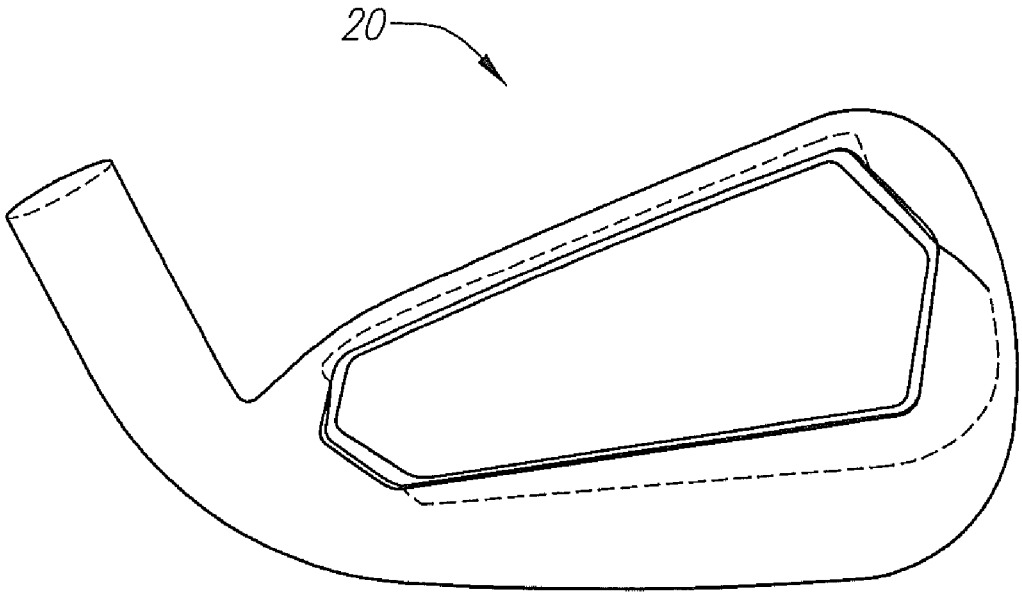
FIG. 7 is rear view of an iron-type golf club head.
Figure 8:
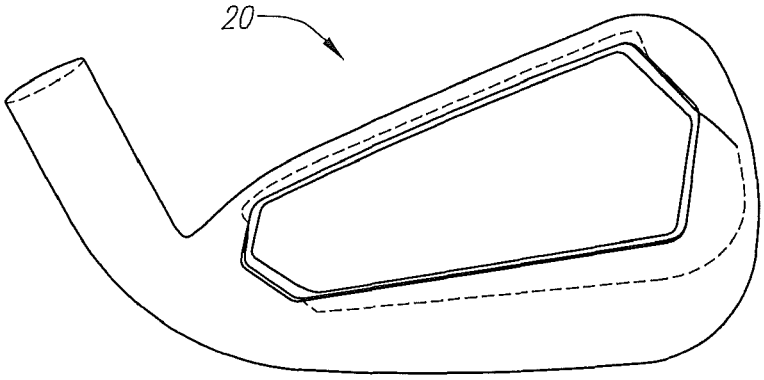
FIG. 8 is a rear view of an iron-type golf club head.
Figure 9:
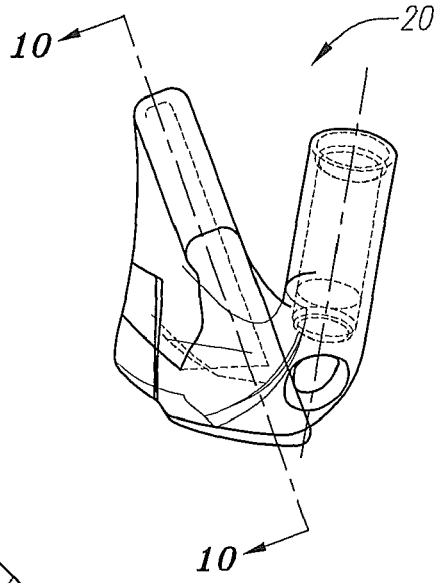
FIG. 9 is a side view of an iron-type golf club head illustrating interior portions.
Figure 10:
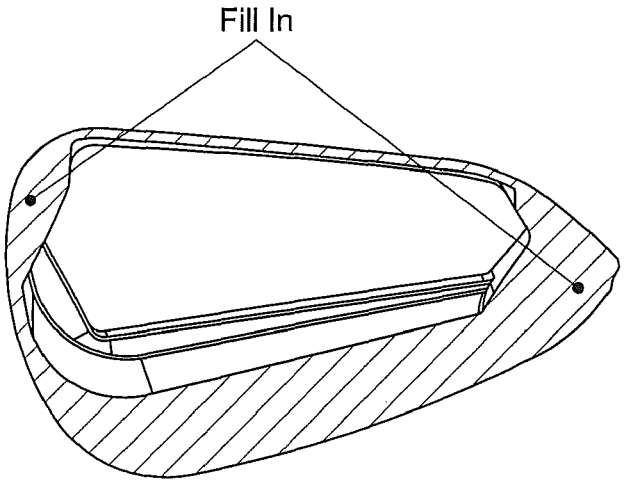
FIG. 10 is a cross-sectional view of along line A-A of FIG. 9.
Figure 11:
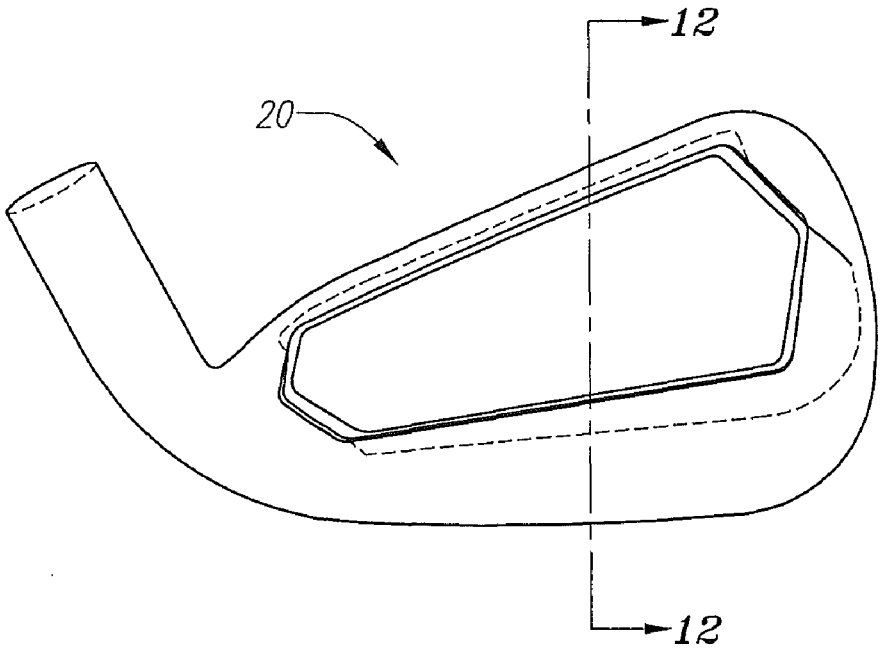
FIG. 11 is a rear view of an iron-type golf club head.
Figure 12:
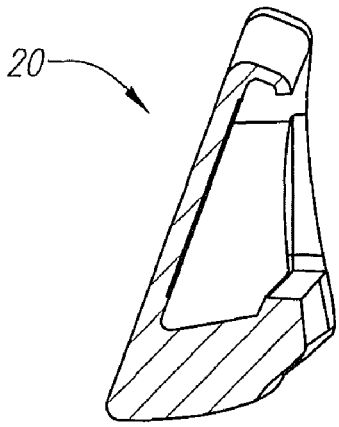
FIG. 12 is a cross-sectional view of along line A-A of FIG. 11.
Figure 13:
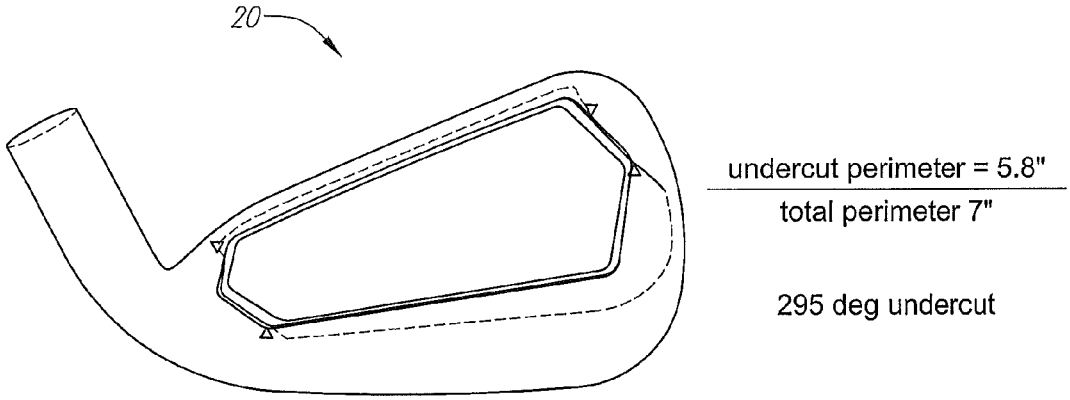
FIG. 13 a rear view of an iron-type golf club head illustrating a 295 degrees undercut portion in a rear cavity.
Figure 14:
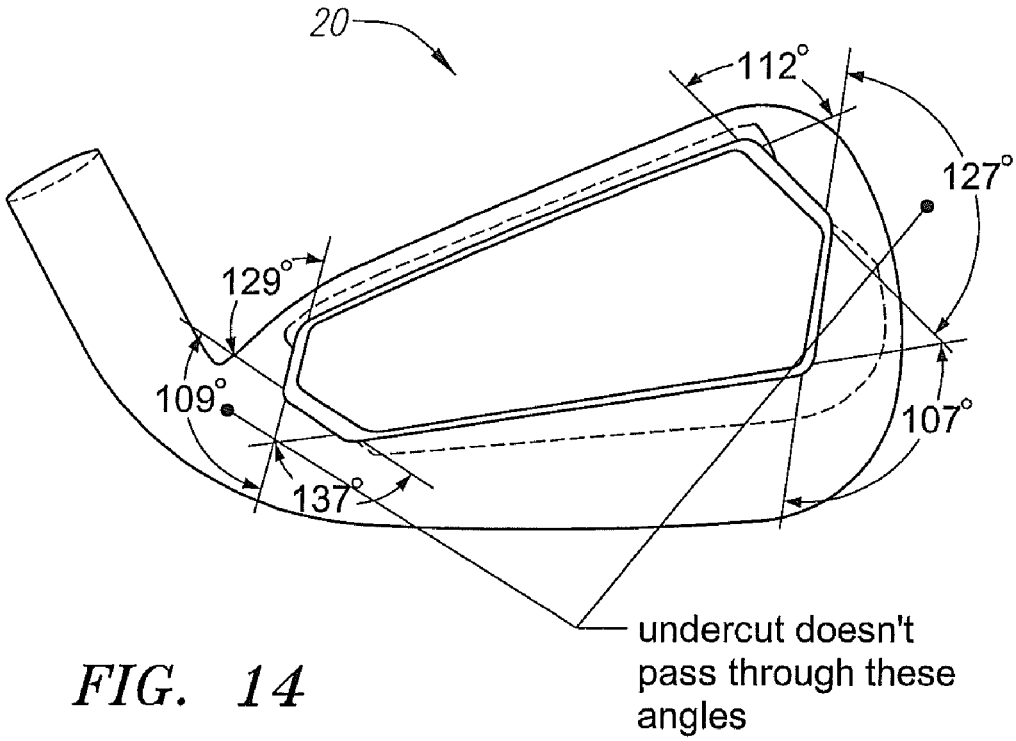
FIG. 14 a rear view of an iron-type golf club head illustrating an alternative means for determining an undercut portion in a rear cavity.
Figure 15:
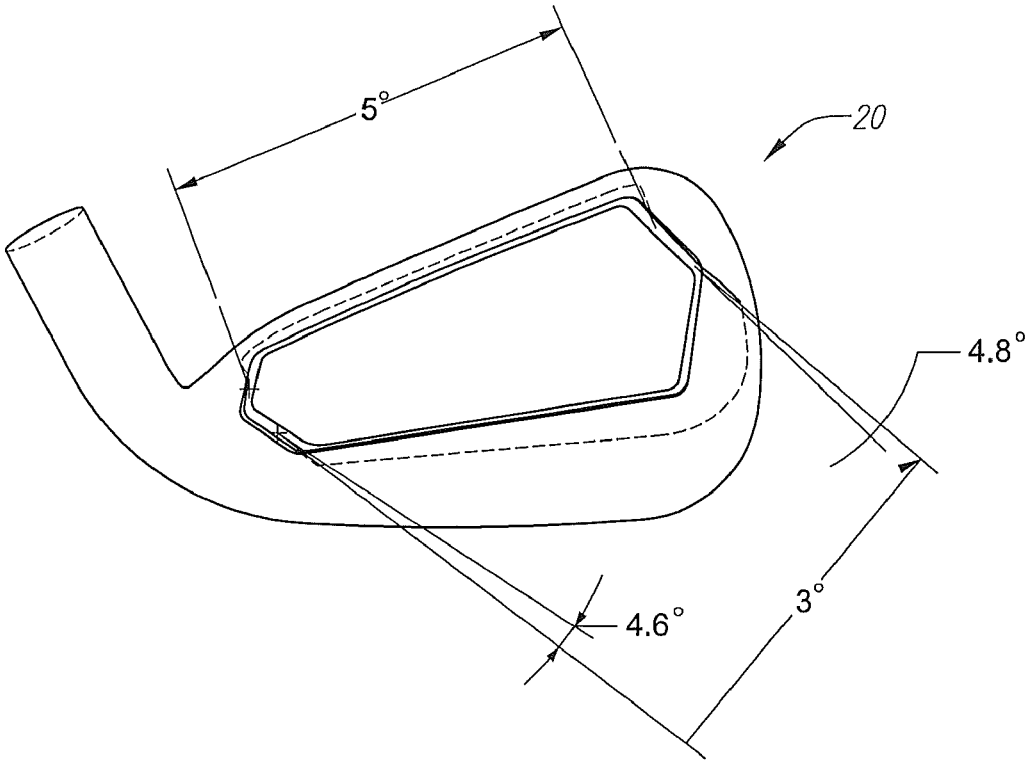
FIG. 15 a rear view of an iron-type golf club head illustrating an alternative means for determining an undercut portion in a rear cavity.
Figure 16:
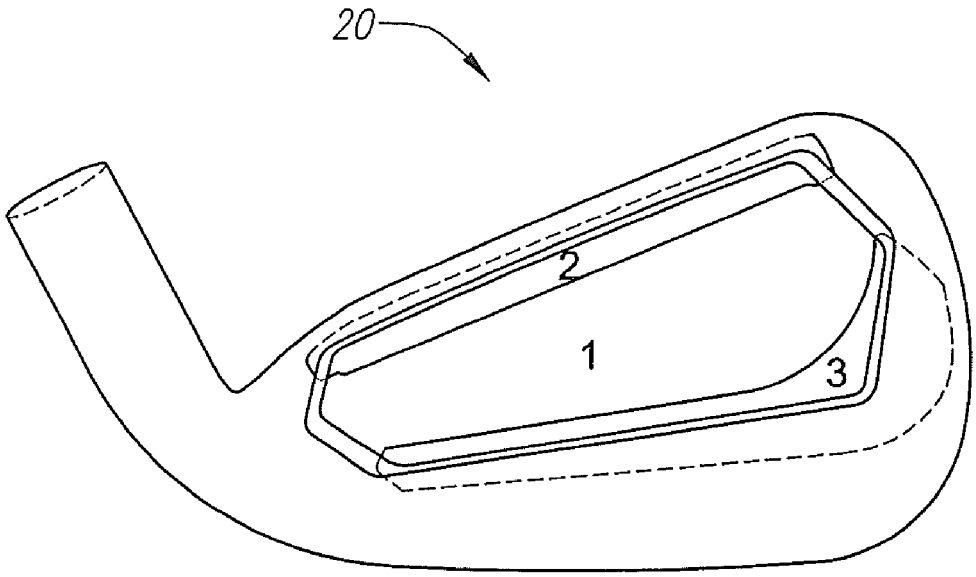
FIG. 16 a rear view of an iron-type golf club head illustrating an alternative means for determining an undercut portion in a rear cavity

As shown in FIGS. 1-16, an iron-type golf club is generally designated 20. The golf club head 20 includes a body 21 having a face 22 with a surface 23 and a plurality of grooves 25. The body 21 is preferably composed of a material such as titanium materials, stainless steel, carpenter steel, 1020 steel, amorphous metals and the like. The material of the body 21 preferably has a density between 4 g/cm$^3$ and 10 g/cm$^3$. Such titanium materials include pure titanium and titanium alloys such as 6-4 titanium alloy, 6-22-22 titanium alloy, 4-2 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. The body 21 is preferably manufactured through casting. Alternatively, the body 21 is manufactured through forging, forming, machining, powdered metal forming, metal-injection-molding, electro-chemical milling, and the like.

In general, the moment of inertia, Izz, about the Z-axis for the golf club head 20 preferably ranges from 2200 g-cm$^2$ to 3000 g-cm$^2$, more preferably from 2400 g-cm$^2$ to 2700 g-cm$^2$, and most preferably from 2472 g-cm$^2$ to 2617 g-cm$^2$. The moment of inertia, Iyy, about the Y-axis for the golf club head 20 preferably ranges from 400 g-cm$^2$ to 700 g-cm$^2$, more preferably from 500 g-cm$^2$ to 600 g-cm$^2$, and most preferably from 530 g-cm$^2$ to 560 g-cm$^2$. The moment of inertia, Ixx, about the X-axis for the golf club head 20 preferably ranges from 2450 g-cm$^2$ to 3200 g-cm$^2$, more preferably from 2500 g-cm$^2$ to 2900 g-cm$^2$, and most preferably from 2650 g-cm$^2$ to 2870 g-cm$^2$.

Alternatively, the structure of the iron-type golf club is such as disclosed in Helmstetter, et al., U.S. Pat. No. 5,776,010, which is hereby incorporated by reference in its entirety.

Alternatively, the structure of the iron-type golf club is such as disclosed in Schmidt, et al., U.S. Pat. No. 5,749,795, which is hereby incorporated by reference in its entirety.

Alternatively, the structure of the iron-type golf club is such as disclosed in Schmidt, et al., U.S. Pat. No. 5,704,849, which is hereby incorporated by reference in its entirety Alternatively, the structure of the iron-type golf club is such as disclosed in Blough et al., U.S. Pat. No. 5,921,869, which is hereby incorporated by reference in its entirety.

Alternatively, the structure of the iron-type golf club is such as disclosed in Kosmatka, U.S. Pat. No. 5,971,868, which is hereby incorporated by reference in its entirety.

Alternatively, the structure of the iron-type golf club is such as disclosed in Kosmatka, U.S. Pat. No. 6,045,455, which is hereby incorporated by reference in its entirety.

Alternatively, the structure of the iron-type golf club is such as disclosed in Kosmatka, U.S. Pat. No. 6,186,905, which is hereby incorporated by reference in its entirety.

Alternatively, the structure of the iron-type golf club is such as disclosed in Erickson, et al., U.S. Pat. No. 6,210,290, which is hereby incorporated by reference in its entirety.

Alternatively, the structure of the iron-type golf club is such as disclosed in Reyes, et al., U.S. Pat. No. 7,144,336, which is hereby incorporated by reference in its entirety.

Alternatively, the structure of the iron-type golf club is such as disclosed in Deshmukh, U.S. Pat. No. 7,112,148, which is hereby incorporated by reference in its entirety.

Alternatively, the structure of the iron-type golf club is such as disclosed in Aguinaldo, et al., U.S. Pat. No. 7,083,531, which is hereby incorporated by reference in its entirety.

Alternatively, the structure of the iron-type golf club is such as disclosed in Wieland, et al., U.S. Pat. No. 7,338,389, which is hereby incorporated by reference in its entirety.

Alternatively, the structure of the iron-type golf club is such as disclosed in Nycum, et al., U.S. Pat. No. 7,338,387, which is hereby incorporated by reference in its entirety.

Alternatively, the structure of the iron-type golf club is such as disclosed in Holt, et al., U.S. Pat. No. 7,326,126, which is hereby incorporated by reference in its entirety.

Figure 17:
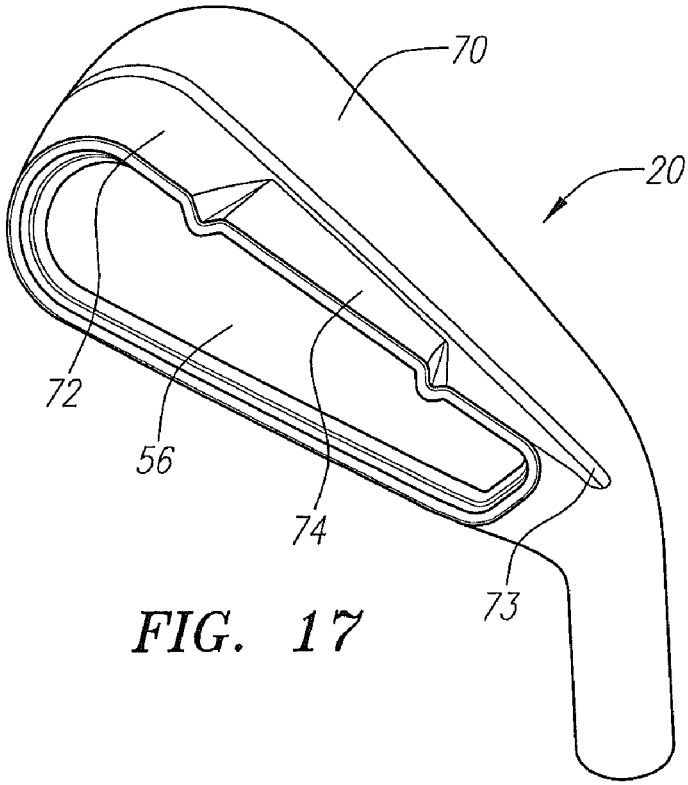
FIG. 17 is a perspective view of an iron-type golf club head.
Figure 18:
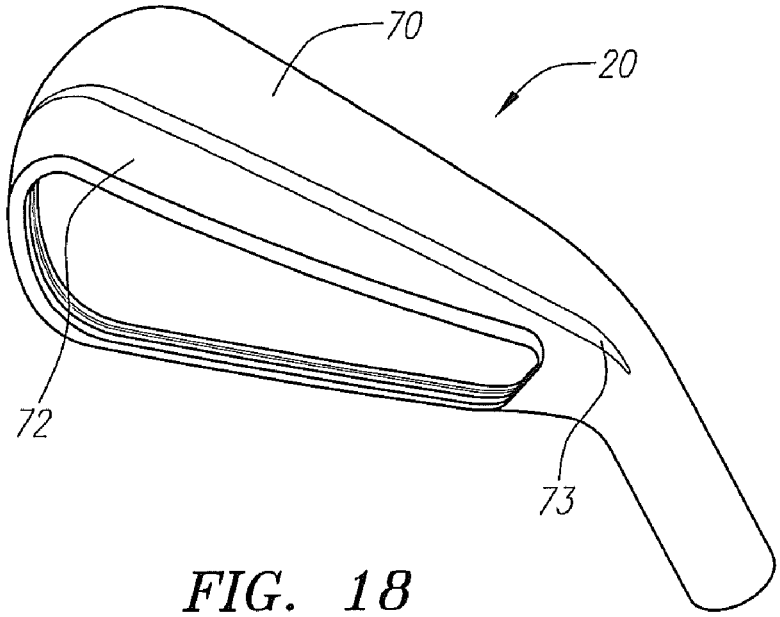
FIG. 18 is a perspective view of an iron-type golf club head.
Figure 19:
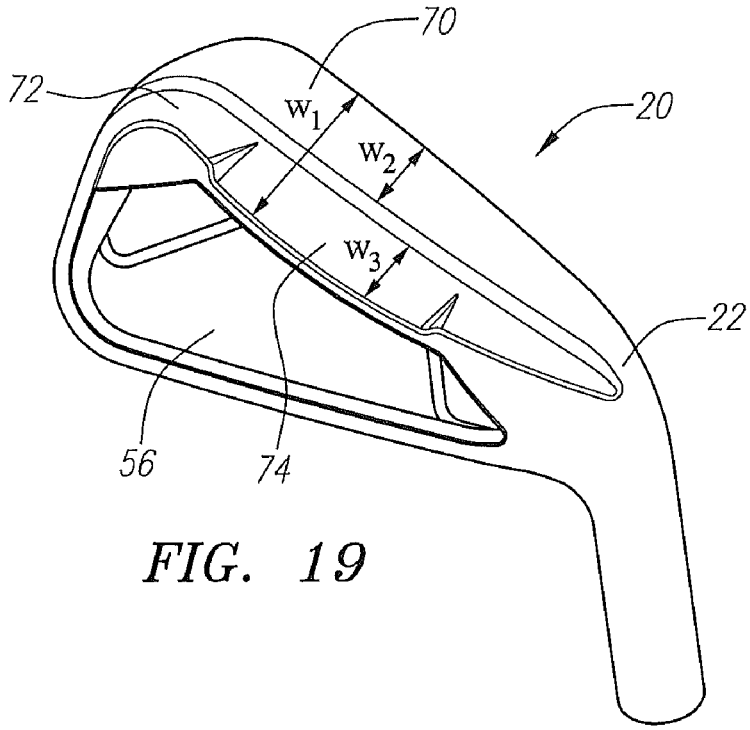
FIG. 19 is a perspective view of an iron-type golf club head.
Figure 20:
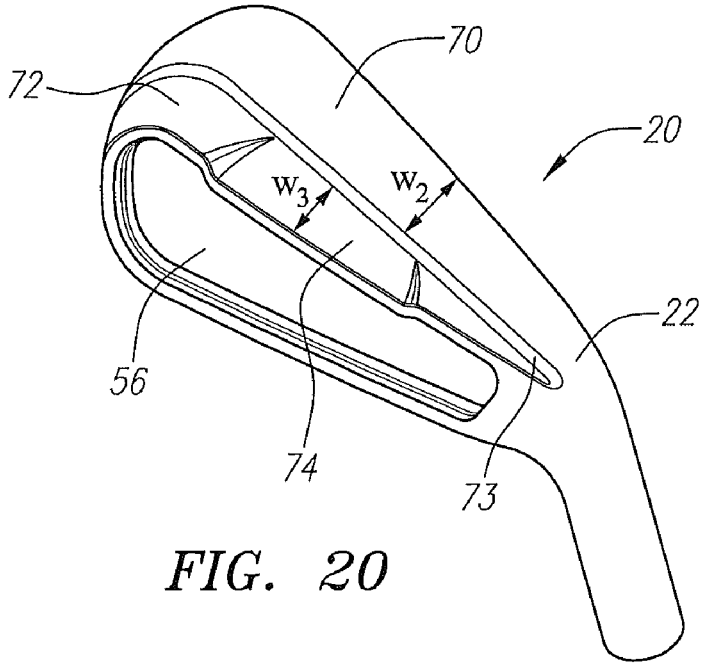
FIG. 20 is a perspective view of an iron-type golf club head.
Figure 21:
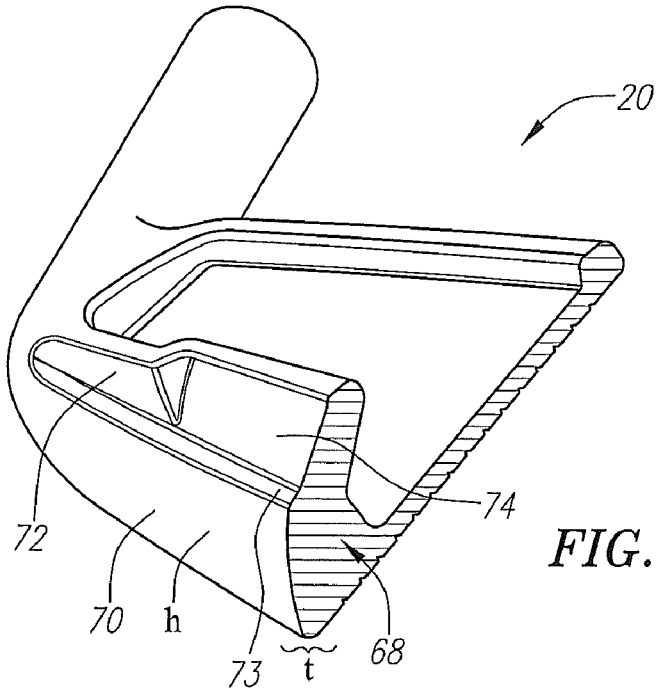
FIG. 21 is a perspective cross-sectional view of an iron-type golf club head.
Figure 22:
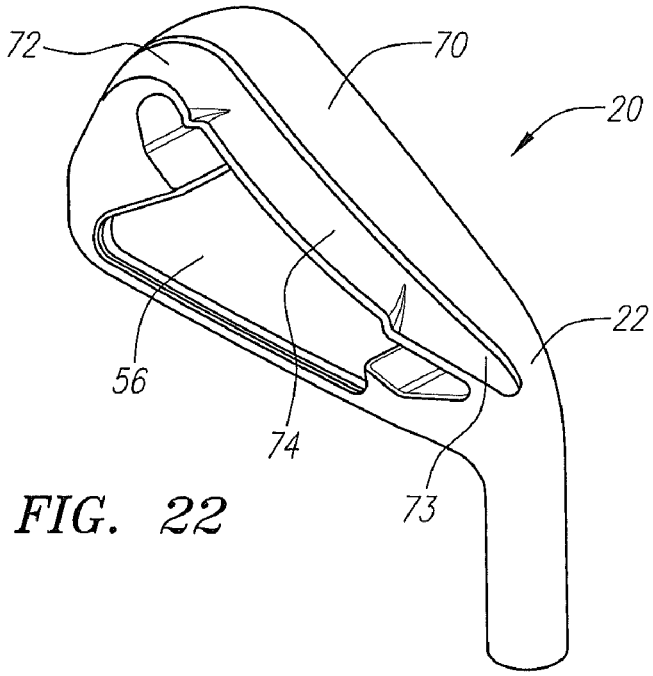
FIG. 22 is a perspective view of an iron-type golf club head.
Figure 23:
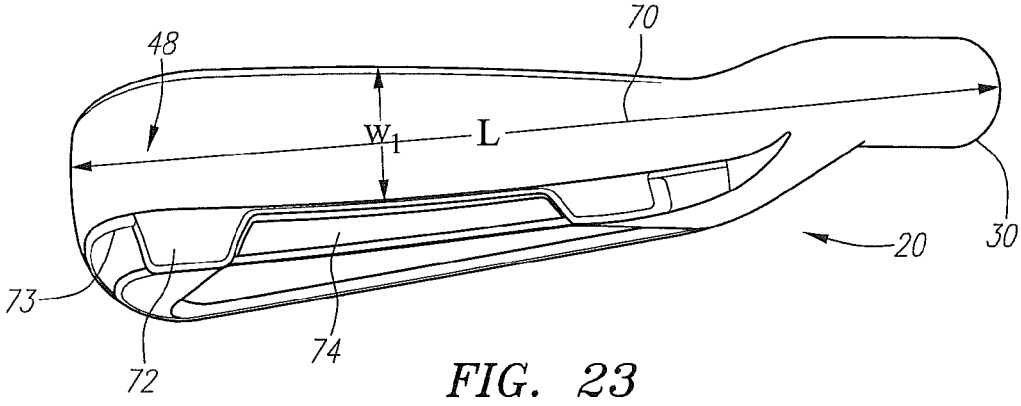
FIG. 23 is a bottom plan view of an iron-type golf club head.
Figure 24:
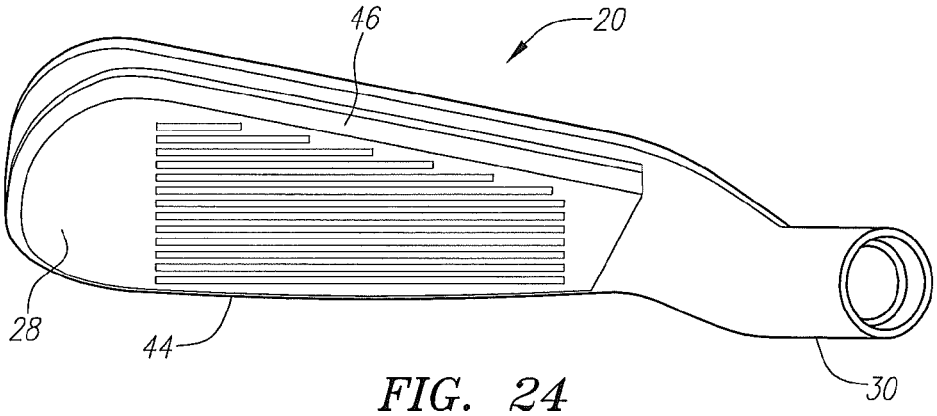
FIG. 24 is a top perspective view of an iron-type golf club head.
Figure 25:
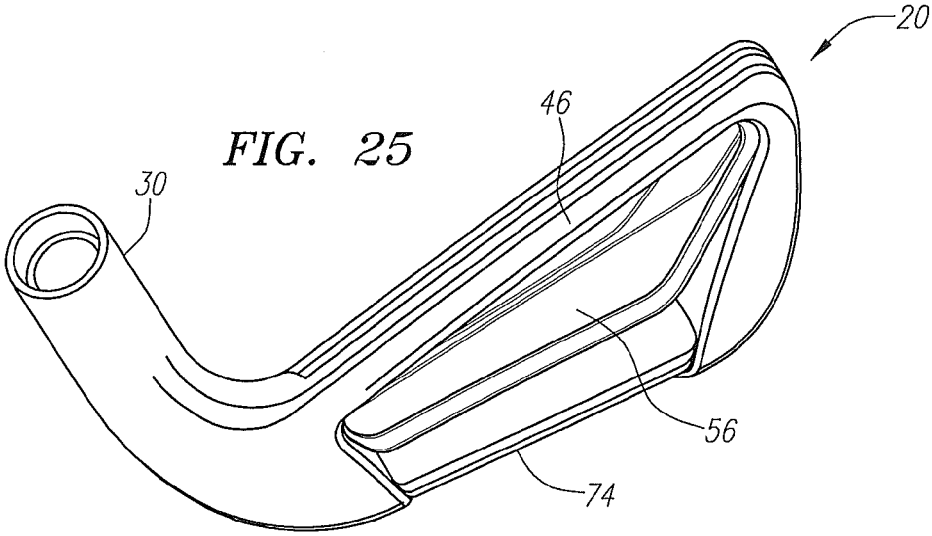
FIG. 25 is a top perspective view of an iron-type golf club head.
Figure 26:
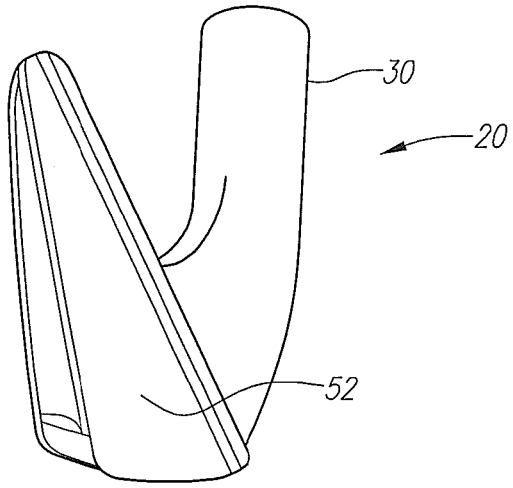
FIG. 26 is a toe-side elevational view of an iron-type golf club head.
Figure 27:
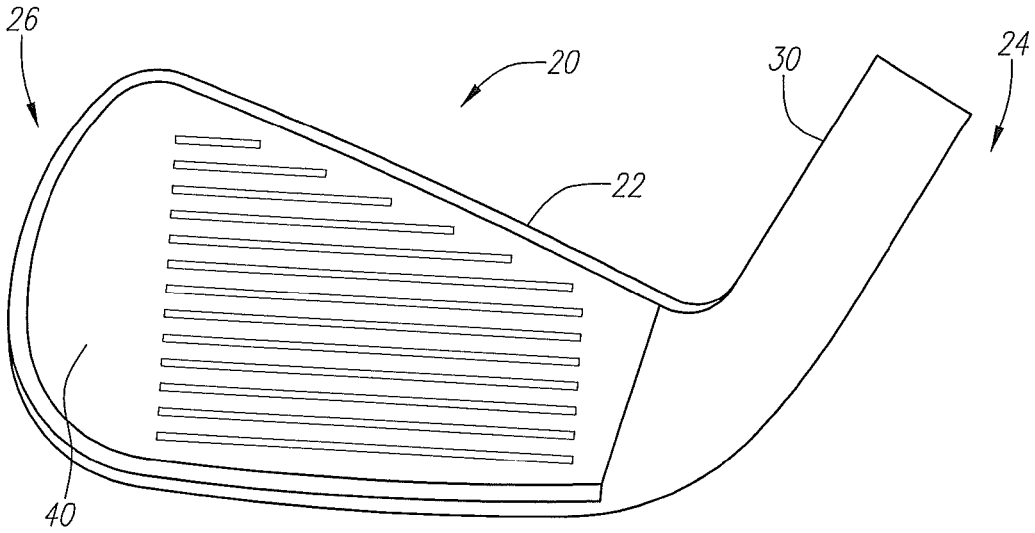
FIG. 27 is a front plan view of an iron-type golf club head.
Figure 28:
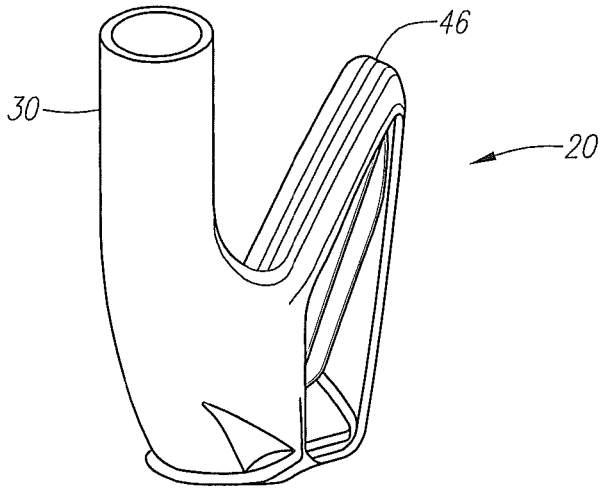
FIG. 28 is a heel side view of an iron-type golf club head.
Figure 29:
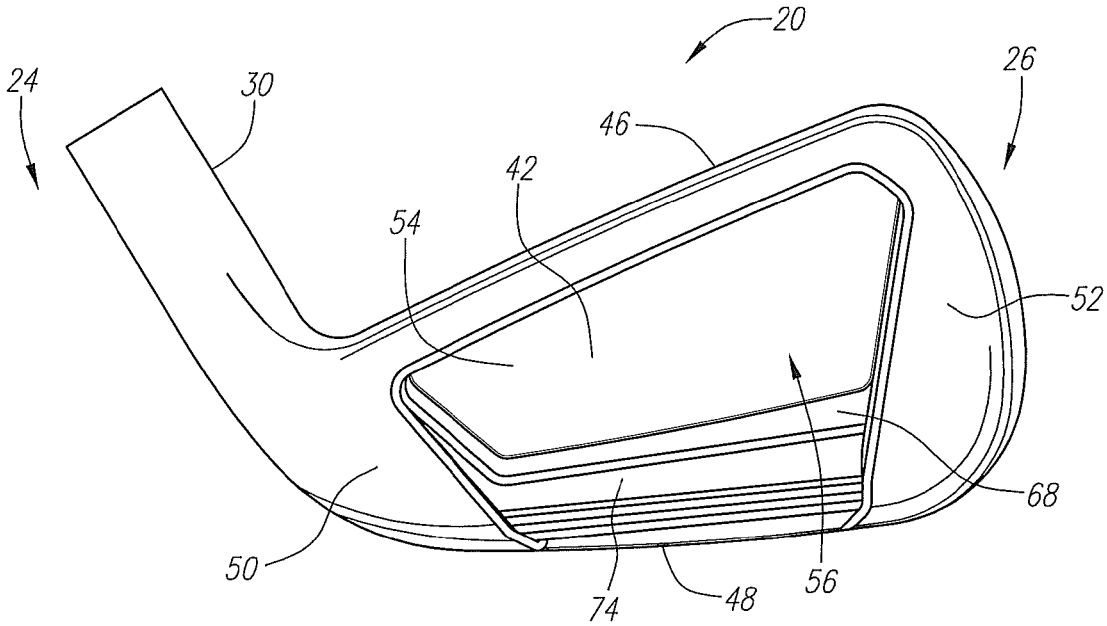
FIG. 29 is a rear plan view of an iron-type golf club head.

As shown in FIGS. 17-29, an iron-type golf club head in accordance with the present invention is generally designated 20. The club head 20 is a cavity-back iron and includes a body 22 having a heel end 24 and a toe end 26. The body 22 has a front wall 28 for contacting a golf ball and a hosel 30 for receiving a shaft, not shown. In a preferred embodiment the golf club head 20 is composed of a stainless steel, however, those of ordinary skill in the art will appreciate that the golf club head 20 may also be composed of other materials, such as carbon steel, titanium, titanium alloy, zirconium or zirconium alloy.

The front wall 28 of golf club head 20 has a ball-striking surface 40 and a back surface 42. The ball-striking surface 40 has a plurality of scorelines 44 formed therein. In a preferred embodiment the top of the hosel 30 is lower than the toe end of the front wall 28, thereby lowering the center of gravity of the club head 20.

The golf club head 20 also has a top portion 46, a sole portion 48, a heel portion 50, a toe portion 52 and a rear surface 54. The top wall 46 extends rearward from the top end of the front wall 28, in a direction opposite the ball-striking surface 40, to the rear surface 54 of the body 22. The sole portion 48 extends rearward from the bottom end of the front wall 28 to the rear surface 54. The heel portion 50 extends rearward from the heel end 24 of the front wall 28 to the rear surface 54, and the toe portion 52 extends rearward from the toe end 26 of the front wall 28 to the rear surface 54. The rear surface 54, the top portion 46, the sole portion 48, the heel portion 50 and the toe portion 52 define an external rear cavity 56 in the body 22 of the club head 20. The top portion 46, the sole portion 48, the heel portion 50 and the toe portion 52 also provide the club head 20 with perimeter weighting to make the club head more forgiving and provide better performance for the typical golfer.

The golf club head 20 preferably includes an undercut recess 68 in communication with the external rear cavity 56. As shown in FIGS. 1-16, the rear cavity 56 is defined by the front wall 28, the top portion 46, the heel portion 50, the toe portion 52 and the sole portion 48, wherein a perimeter of the rear cavity 56 is composed of a plurality of segments, a first segment extending along the top portion 46, a second straight segment extending along the heel portion 50, a third straight segment distinct from the second straight segment and forming an included angle greater than zero with respect to the second straight segment and extending along the heel portion 50, a fourth straight segment extending along the toe portion 52, a fifth straight segment distinct from the fourth straight segment and forming an included angle greater than zero with respect to the fourth straight segment and extending along a toe portion 52, and a sixth straight segment extending along the stepped surface of the sole portion 48. The undercut recess 68 preferably circumscribes the external rear cavity 56. Alternatively, the undercut recess 68 may extend along only a portion of the external rear cavity 56. A medallion, not shown, is preferably disposed in the external rear cavity 56 of the body 22.

As shown in FIGS. 17-29, the present invention creates a geometry that is aesthetically pleasing, consistent with the best mass properties and accommodating to the golfers interest in sole shapes that minimize interference between the turf and club head. This is accommodated by combining features of better player clubs and with improving player clubs. The radius of the face to sole transition is designed to be a smaller radius to maximize the extension of the flat face within the ball contact locations. Also the radius design penetrated the turf better than a more blunt face to sole transition.

The sole is extended away from the face to improve the mass properties of the center of mass, the mass distribution, appeal, and for clearance between the club head and the turf during the follow through of the swing. The sole is stepped such that the sole surface furthest from the face is raised away from the turf to minimize the turf contact through the swing particularly for the longer, less lofted "irons". The surface friction is reduced by applying a thin dense chromium coating thorough electroplating. The sole portion has a length ranging from 7.5 cm to 10.0 cm and a width ranging from 1.0 cm to 4.0 cm, wherein the main surface has a width ranging from 1.0 cm to 2.5 cm, wherein the stepped surface has a width ranging from 0.25 cm to 1.5 cm, and wherein the edge has a height ranging from 0.3 cm to 0.5 cm.

The appeal of the step and associated geometry is detailed for both appearance and preferential shape.

The invention creates a unique combination of head shape and surface friction coefficients that minimize the bad effects of turf impact.

Further, this invention creates a geometry that is aesthetically pleasing, consistent with the best mass properties and accommodating to the golfers interest in sole shapes that minimize interference between the turf and club head. This is accommodated by combining features of better player clubs and with improving player clubs. The radius of the face to sole transition is designed to be a smaller radius to maximize the extension of the flat face within the ball contact locations. Also the radius design penetrated the turf better than a more blunt face to sole transition.

The sole is extended away from the face to improve the mass properties of the center of mass, the mass distribution, appeal, and for clearance between the club head and the turf during the follow through of the swing. The sole is stepped such that the sole surface furthest from the face is raised away from the turf to minimize the turf contact through the swing particularly for the longer, less lofted "irons".

The step geometry is also aesthetically advantageous.

An iron-type golf club head in accordance with the present invention is generally designated. The club head is a cavity-back iron and includes a body having a heel end and a toe end. The body has a front wall for contacting a golf ball and a hosel for receiving a shaft, not shown. The hosel has a bore with an ingress opening and optionally an egress opening. In a preferred embodiment the golf club head is composed of a stainless steel, however, those of ordinary skill in the art will appreciate that the golf club head may also be composed of other materials, such as carbon steel, titanium, titanium alloy, zirconium or zirconium alloy.

The front wall of golf club head has a ball-striking surface and a back surface. The ball-striking surface has a plurality of scorelines formed therein. In a preferred embodiment the top of the hosel is lower than the toe end of the front wall, thereby lowering the center of gravity of the club head.

The golf club head also has a top wall, a bottom wall, a heel wall, a toe wall and a rear surface. The top wall extends rearward from the top end of the front wall, in a direction opposite the ball-striking surface, to the rear surface of the body. The bottom wall extends rearward from the bottom end of the front wall to the rear surface. The heel wall extends rearward from the heel end of the front wall to the rear surface, and the toe wall extends rearward from the toe end of the front wall to the rear surface. The rear surface, the top wall, the bottom wall, the heel wall and the toe wall define an external rear cavity in the body of the club head. The top wall, the bottom wall 48, the heel wall and the toe wall also provide the club head with perimeter weighting to make the club head more forgiving and provide better performance for the typical golfer.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim:

1. An iron-type golf club head comprising:

a body composed of a stainless steel material and having a front wall, a top portion, a heel portion a toe portion and a sole portion, the sole portion extending rearward from the front wall and having a main surface, coated stepped surface and an edge between the main surface and the coated stepped surface, wherein the sole portion has a length ranging from 7.5 cm to 10.0 cm and a width ranging from 1.0 cm to 4.0 cm, wherein the main surface has a width ranging from 1.0 cm to 2.5 cm, wherein the stepped surface has a width ranging from 0.25 cm to 1.5 cm, and wherein the edge has a height ranging from 0.3 cm to 0.5 cm; a rear cavity defined by the front wall, the top portion, the heel portion, the toe portion and the sole portion, wherein a perimeter of the rear cavity is composed of a plurality of segments, a first segment extending along the top portion, a second straight segment extending along the heel portion, a third straight segment distinct from the second straight segment and forming an included angle greater than zero with respect to the second straight segment and extending along the heel portion, a fourth straight segment extending along the toe portion, a fifth straight segment distinct from the fourth straight segment and forming an included angle greater than zero with respect to the fourth straight segment and extending along a toe portion, and a sixth straight segment extending along the stepped surface of the sole portion;

wherein the sole is extended away from the face to improve the mass properties of the center of mass, the mass distribution, and for clearance between the club head and the turf during the follow through of a golf swing.

2. An iron-type golf club head comprising:

a body composed of a stainless steel material and having a front wall, a hosel, a heel portion, a toe portion, top portion, and a sole portion; the heel portion, the toe portion, the top portion and the sole portion forming an external rear cavity; the sole portion extending rearward from the front wall and having a main surface, coated stepped surface and an edge between the main surface and the coated stepped surface, wherein the sole portion has a length ranging from 7.5 cm to 10.0 cm and a width ranging from 1.0 cm to 4.0 cm, wherein the main surface has a width ranging from 1.0 cm to 2.5 cm, wherein the stepped surface has a width ranging from 0.25 cm to 1.5 cm, and wherein the edge has a height ranging from 0.3 cm to 0.5 cm; wherein a perimeter of the rear cavity is composed of a plurality of segments, a first segment extending along the top portion, a second straight segment extending along the heel portion, a third straight segment distinct from the second straight segment and forming an included angle greater than zero with respect to the second straight segment and extending along the heel portion, a fourth straight segment extending along the toe portion, a fifth straight segment distinct from the fourth straight segment and forming an included angle greater than zero with respect to the fourth straight segment and extending along a toe portion, and a sixth straight segment extending along the stepped surface of the sole portion;

wherein the body further comprises an undercut recess;

wherein the sole is extended away from the face to improve the mass properties of the center of mass, the mass distribution, and for clearance between the club head and the turf during the follow through of a golf swing.

* * * * *